United States Patent [19]

Westfall et al.

[11] Patent Number: 4,837,976

[45] Date of Patent: Jun. 13, 1989

[54] WINDOW BALANCE SPRING COVER FRICTION SYSTEM

[75] Inventors: Norman R. Westfall, Rochester; Patrick E. Milligan, Kendall, both of N.Y.

[73] Assignee: Caldwell Manufacturing Company, Rochester, N.Y.

[21] Appl. No.: 170,781

[22] Filed: Mar. 21, 1988

Related U.S. Application Data

[63] Continuation-in-part of Ser. No. 58,796, Jun. 5, 1987, Pat. No. 4,779,380.

[51] Int. Cl.[4] ..... E05F 1/00

[52] U.S. Cl. ..... 49/430; 49/176

[58] Field of Search ..... 49/430, 429, 445, 446, 49/432, 481, 176

[56] References Cited

U.S. PATENT DOCUMENTS

| | | | |
|---|---|---|---|
| 2,593,658 | 4/1952 | Davis | 49/432 |
| 2,747,219 | 5/1956 | Haas | 49/430 |
| 3,058,176 | 10/1962 | Zegers | 49/429 X |
| 3,482,354 | 12/1969 | Trout | 49/446 X |
| 3,499,248 | 3/1970 | Baer | 49/430 |
| 3,524,282 | 8/1970 | Kraft et al. | 49/445 X |
| 3,633,317 | 1/1972 | Koebel | 49/430 |
| 3,643,377 | 2/1972 | Anderson | 49/181 |
| 3,842,540 | 10/1974 | Anderson | 49/181 |
| 4,570,382 | 2/1986 | Suess | 49/430 |
| 4,571,887 | 2/1986 | Haltof | 49/429 |

*Primary Examiner*—Philip C. Kannan

*Attorney, Agent, or Firm*—Stonebraker, Shepard & Stephens

[57] ABSTRACT

An extruded resin spring cover (12) extending for the full length of a resin jamb liner (10) and divided into vertical halves (14) by a longitudinal slit (15) is involved in a friction system that prevents hop or drop of a sash (13) counterbalanced between jamb liners (10). A counterbalance spring system is arranged within spring cover (12) and connected to a platform (20) that has a narrow width neck (24 or 44) extending through slit (15). A sash support portion (25, 37, or 57) of the platform is pivotally mounted outside the spring cover, and a connector portion (30, 35, or 40) of the platform is connected to the counterbalance spring system within the spring cover. Neck (24 or 44) extending through slit (15) affords the pivotal interconnection between the sash support portion and the connection portion and also contributes a fixed friction load involved in spreading the spring cover halves apart at the slit, in the region of the neck. The rest of the friction load is provided by a friction shoulder (26 or 46) on the connector portion engaging the inside of the spring cover and a friction surface (27, 38, or 58) on the sash support portion engaging the outside of the spring cover.

17 Claims, 4 Drawing Sheets

WINDOW BALANCE SPRING COVER FRICTION SYSTEM

This joint application is a Continuation-In-Part of copending parent application Ser. No. 058,796, filed June 5, 1987, 5 June now U.S. Pat. No. 4,779,380, issued Oct. 25, 1988, entitled SPRING COVER FRICTION SYSTEM FOR SASH BALANCE, which was the sole invention of one of the joint inventors of this application.

BACKGROUND

Window balance systems using resin jamb liners with spring covers have generally limited the spring covers to the upper half of each jamb linear and have let sash platforms move up and down with the sashes in the bottom halves of the jamb liners where no spring covers interfere with platform movement. The Suess U.S. Pat. No. 4,570,382 has suggested full length spring covers extending from top to bottom of the jamb liners with open vertical slots through which sash platforms can extend into adjustable friction shoes that ride up and down inside the spring covers. The spring covers require extra internal walls providing tracks for the friction shoes to work against.

Instead of an open slot and extra internal walls in a spring cover, as suggested by Suess, we have discovered a way that a platform can work with a spring cover that is simply slit so that the platform and the spring cover can achieve the friction necessary to prevent hop or drop of the balanced sash. Our friction system not only uses a less expensive construction, but also provides a frictional resistance that is variable as a function of the spring force pulling up on the platform and the weight of a sash resting on the platform.

Our window balance spring cover friction system enables a sash support surface to pivot in either direction from horizontal, to accommodate the 14° slope that is standard for the window sill and the bottom rail of a lower sash. Our system also divides the friction between a fixed load that is constant, regardless of the sash weight and the spring force, and a changeable load that varies as a function of sash weight and spring force. The two friction loads both involve the spring cover of the resin jamb liner and are combined according to our invention to prevent hop and drop of a sash, while allowing easy vertical movement.

SUMMARY OF THE INVENTION

Our window balance spring cover friction system applies to a sash that is counterbalanced between a pair of extruded resin jamb liners having spring covers extending for the full vertical length of the jamb liners. A vertical slit divides a spring cover into vertical halves that normally close together, but are resiliently movable apart from each other. A platform for the sash includes a connector portion vertically movable within the spring cover and connected to a counterbalance spring system arranged within the spring cover. A sash support portion of the platform is pivotally connected to the connector portion and has a surface disposed outside of the spring cover for supporting the sash, the sash support portion being tiltable in either direction from horizontal, to accommodate the incline at the bottom of a lower rail of a lower sash, if necessary. The platform also includes a narrow width neck extending through the slit in the spring cover between the connector portion and the sash portion, and the neck affords the pivotal connection between the sash support portion and the connector portion.

The neck moves the halves of the spring cover apart in the region of the neck so that local separation of the spring cover halves, as the neck moves vertically along the slit, produces a constant friction load resisting vertical movement of the platform. The sash support portion has a friction surface wider than the neck and facing inward to engage the outside of the spring cover, and the connector portion has a friction shoulder wider than the neck and facing outward to engage the inside of the spring cover for deforming the spring cover between the friction shoulder and the friction surface. This vertical deformation of the spring cover provides a friction load that varies as a function of the weight of the sash urging the sash support downward and the force of a counterbalance spring system urging the connector upward. The variable friction load combines with the constant friction load to resist hop and drop of the balanced sash.

DRAWINGS

DETAILED DESCRIPTION

Figure 1:
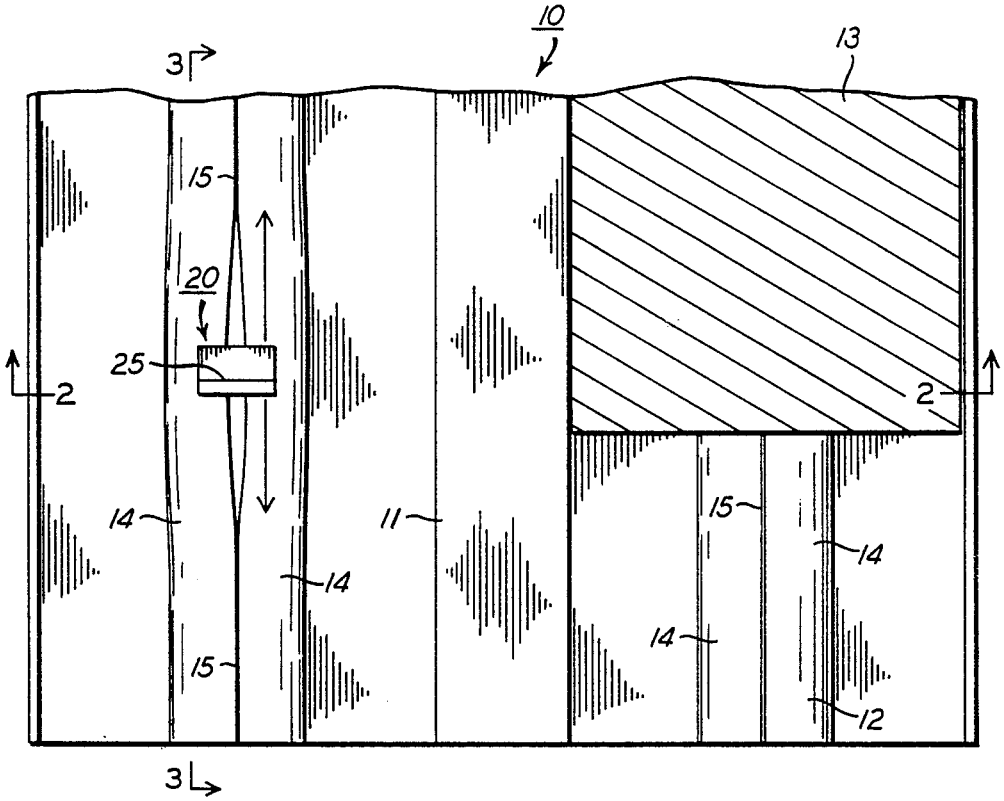
FIG. 1 is a fragmentary side elevational view of a preferred embodiment of our platform and spring cover friction system, showing a platform in one spring cover of a jamb liner.
Figure 2:
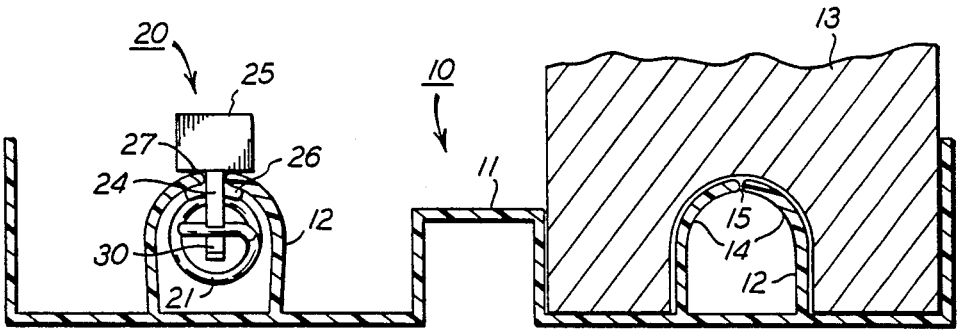
FIG. 2 is a lateral cross-sectional view of the system of FIG. 1, taken along the line 2—2 thereof.
Figure 3:
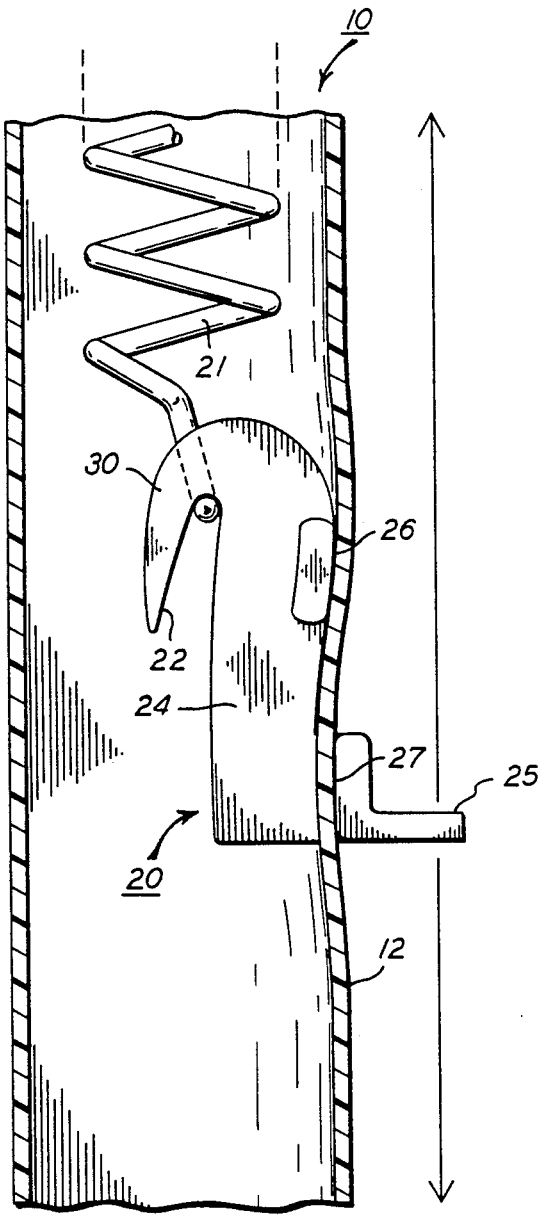
FIG. 3 is a vertical cross-sectional view of the system of FIG. 1, taken along line 3—3 thereof.
Figure 4:
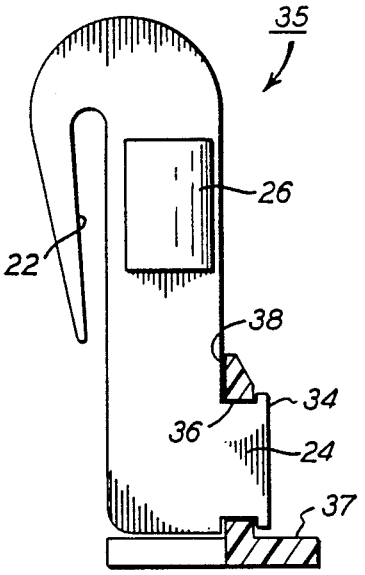
FIG. 4 is a partially cutaway, side elevational view of another preferred embodiment of a sash platform according to our invention.
Figure 5:
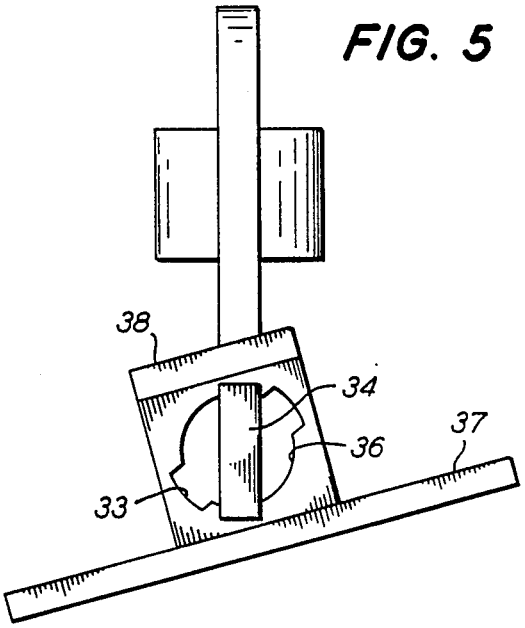
FIG. 5 is a front elevational view of the sash platform of FIG. 4.

Considering first the embodiment of FIGS. 1–3, our system applies to an extruded resin jamb liner 10 arranged on opposite sides of a balanced sash. For a double-hung window, jamb liner 10 includes a parting bead 11 separating a pair of sash runs, one of which contains a sash 13, and each of which has a spring cover 12. Usually these occupy only the upper half of each jamb liner, but for our friction system, one or two spring covers 12 extend the full length of jamb liner 10. This simplifies and reduces the expense of jamb liner extrusion, compared with the cutting away of spring covers in the lower half of a jamb liner or the adding of spring covers to an upper half.

During the extrusion of jamb liner 10, spring covers 12 are cut to form longitudinal slits 15, also extending from top to bottom of jamb liner 10, to divide each spring cover 12 into a pair of vertical halves 14. A simple knife arranged downstream of an extrusion die can form slit 15, and we prefer that the edges of the spring cover halves that confront at slit 15 be rounded, as best shown in FIG. 2. Although slit 15 can be formed to remain open, separating the vertical halves 14 of spring cover 12, we prefer that these normally contact each other along slit 15. This helps keep dirt out of the inside of spring cover 12, and also adds to vertical movement resistance as explained below.

Platform 20 rides up and down in slit 15 in spring cover 12, as illustrated. Platform 20 can be injection molded of a single piece of resin material to form a sash support 25 extending outside of spring cover 12 and a spring connector 30 arranged inside of spring cover 12. A spring 21 connects to connector 30 at a hook 22 or hole through connector 30, and a sash rests its weight on support 25. A neck 24 between connector 30 and sash support 25 is relatively narrow and extends through slit 15. As platform 20 moves up and down spring cover 12, neck 24 spreads apart the halves 14 of spring cover 12 at slit 15, as shown in FIG. 1. This deforms the spring cover halves 14 laterally, requiring some force to change the vertical position of platform 20. This force represents a constant friction load, as explained more fully below. At a short distance from platform 20, the edges of the longitudinal halves 14 of spring cover 12 return to their normal position to contact each other along slit 15, again as shown in FIG. 1.

An inside friction shoulder 26 on the spring connector side of neck 24 is wider than neck 24 and faces outward to engage an inward facing inside surface of spring cover 12 on opposite sides of slit 15. An outside friction surface 27, also wider than neck 24, faces inward to engage an outward facing surface of spring cover 12 on the sash support side of neck 24. Since spring 21 pulls upward on platform 20 on the inside of spring cover 12, while the weight of a sash pushes downward on support 25 outside of spring cover 12, these opposing forces tend to tilt platform 20, as exaggerated in FIG. 3. This deforms the spring cover outward in an upper region where it is engaged by inside friction shoulder 26 and inward in a lower region where it is engaged by outside friction surface 27. The resulting S-curve deformation of spring cover 12 produces some additional resistance to vertical movement of platform 20.

Besides the spring cover deformation forces, friction surfaces 26 and 27 provide frictional resistance to moving platform 20 vertically along spring cover 12, and this frictional resistance is a function of the force of spring 21 and the weight of sash resting on support 25. The friction forces created by surfaces 26 and 27, which are preferably rounded in the regions where they engage surfaces of spring cover 12, are thus load related and vary with changes in spring force and sash weight. These combine with the spring cover deformation forces to provide resistance to vertical movement, preventing hop or drop of the supported sash. Locating friction surfaces 26 and 27 vertically farther apart makes them less load responsive, and locating them vertically closer together makes them more load responsive.

The forces required for neck 24 to spread apart spring cover halves 14 and slide vertically in slit 15 are constant, regardless of the weight of a sash or the force of a counterbalance spring system. The forces required for platform 20 to deform sash cover 12 in a vertical S-curve and slide upper friction shoulder 26 and lower friction surface 27 vertically against the spring cover wall are load-responsive and exert more resistance for a heavier sash and a stronger counterbalance spring. We prefer that the constant friction and sash deformation forces have about one-half the platform movement resistance of the variable friction and sash deformation forces that are responsive to sash weight and spring forces. This makes about one-third of the movement resistance constant and about two-thirds of the movement resistance variable with the sash weight and the spring force. We also prefer that the constant movement resistance be small enough so that a platform rises within spring cover 12 when sash weight is removed from the platform. Moreover, we prefer that the variable movement resistance be small enough so that for the heaviest sash to be balanced with the strongest counterbalance spring system, friction shoulder 26 and friction surface 27 will not jam against opposite faces of spring cover 12. These conditions allow a single platform to be used according to our invention to provide a suitable total movement resistance for several different weights of sash and counterbalance spring forces.

Another feature that we prefer for making a single sash platform usable in different situations is to provide a tilting capability for the sash support portion of the platform. Two preferred ways of accomplishing this are shown in the embodiments of FIGS. 4–7 and 8–11. These embodiments also differ in the way they connect to a counterbalance spring, and other connection possibilities that are not illustrated can also be used. For example, a counterbalance spring system can use a block and tackle system arranged within spring cover 12 and connecting the end of a cord to the connector portion of a sash platform made according to our invention.

For the embodiment of FIGS. 4–7, a connector portion 35, similar to connector 30, has a spring-receiving hook 22, an upper friction shoulder 26, and a neck 24 that can extend through slit 15 in spring cover 12. Instead of a sash support formed integrally with connector 35, sash support 37 has a hole 36 in its friction surface 38 for fitting over neck 24 of connector 35. A head 34 at the end of neck 24 can fit through an enlarged region 33 of hole 36 so that sash support 37 can mount on and pivot on neck 24 to tilt in either direction from horizontal, while head 34 keeps sash support 37 pivotally joined to connector 35.

Figure 6:
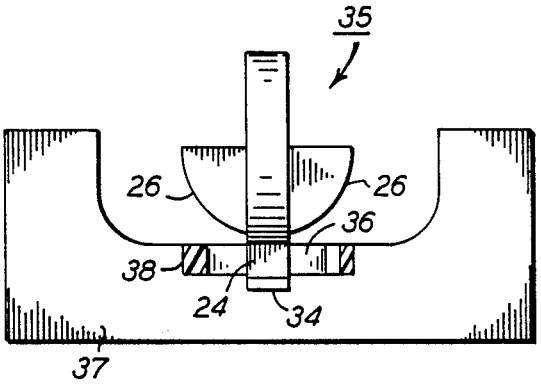
FIG. 6 is a partially cutaway top view of the sash platform of FIGS. 4 and 5.
Figure 7:
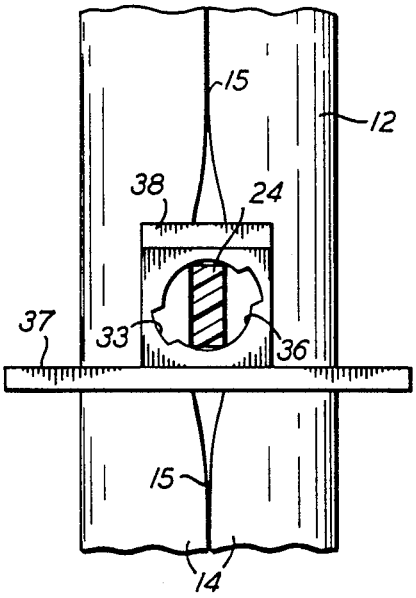
FIG. 7 is a partially cutaway elevational view of the sash platform of FIGS. 4–6, arranged within a resin spring cover of a jamb liner.

As best shown in FIG. 6, sash support 37 curves to fit around the outside of a spring cover 12; and friction shoulders 26, on connector 35, correspondingly curve to fit the inside surface of a spring cover 12. As shown in FIG. 7, and as explained above, neck 24 spreads apart the vertical halves 14 of spring cover 12 to create a fixed vertical resistance of movement of sash support 37.

Figure 10:
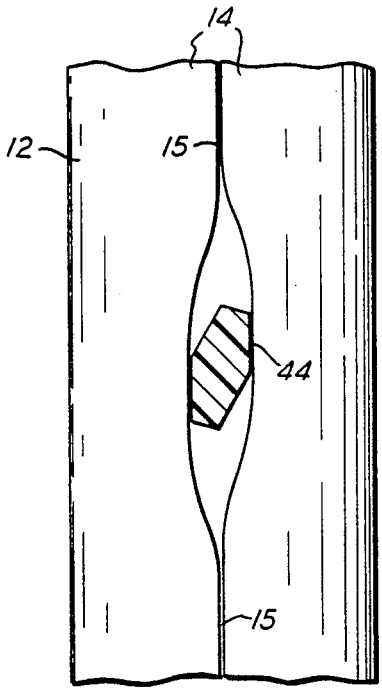
FIGS. 10 and 11 are cross-sectional views of the neck portion of the sash platform of FIGS. 8 and 9 disposed at different tilt angles within a slit in a resin spring cover.
Figure 11:
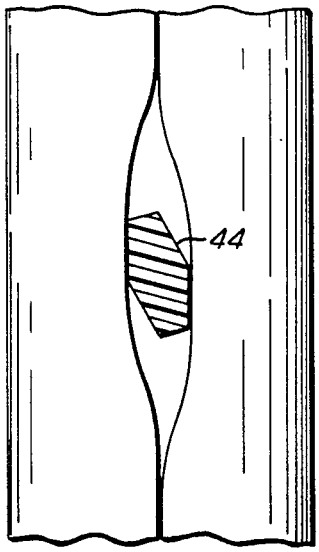
Figure 8:
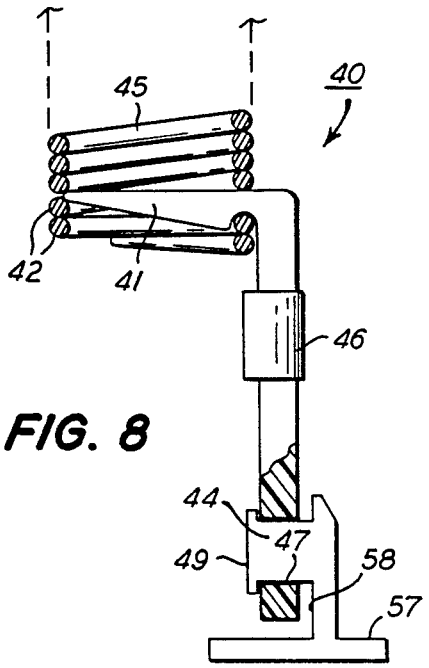
FIG. 8 is a partially cutaway, side elevational view of another preferred embodiment of our sash platform, shown connected to a counterbalance spring.
Figure 9:
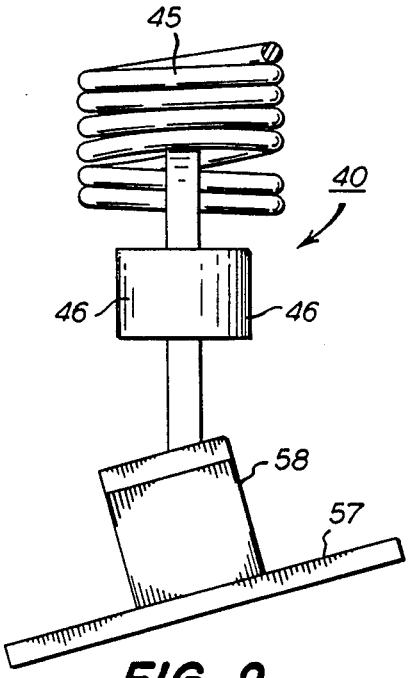
FIG. 9 is a front elevational view of the sash platform of FIG. 8.

In the embodiment of FIGS. 8–11, connector 40 has an interlocking wedge 41 that fits between terminal coils 42 of a spring 45, in way that is generally known in the window balance art. Connector 40 also includes friction shoulders 46 for engaging the inside surface of a resin spring cover. A lower region of connector 40 has a hole 47 that can receive head 49 and can pivotally house neck 44 extending inwardly from a friction surface 58 of a sash support 57, which is thereby make free to tilt in either direction from horizontal. One tilt direction of sash support 57 is shown in FIG. 9, and sash support 57 is preferably curved in a shape similar to sash support 37 of FIG. 6. Since neck 44 tilts with sash support 57, it is preferably oval or slope-sided as shown in FIGS. 10 and 11, so that it spreads apart the vertical halves 14 of spring cover 12 by the same amount, whether tilted or perpendicular to sash cover 12. The hole 47 in connector 40 is preferably shaped like hole 36, with enlargements 33, for receiving head 49 of neck 44. However, many other configurations of heads, necks, and pivot holes can be used for pivotally interconnecting the connector portion and the sash support portion of a platform according to our invention.

We claim:

1. A spring cover for an extruded resin jamb liner, said spring cover extending for the full length of said jamb liner and comprising:

a. a slit dividing said spring cover into two vertical halves disposed to contact each other to keep said spring cover closed along the length of said slit; and b. said spring cover halves being resilient enough to be spread apart to allow a sash platform to extend through said slit and move up and down in said slit while said slit remains closed in regions spaced from said platform.

2. The spring cover of claim 1 wherein edges of said slit are rounded.

3. The spring cover of claim 1 wherein said halves, in cross section, form a D-shaped with a semi-circular region divided by said slit.

4. A sash platform comprising:

a. a connector portion connectable to a spring system and shaped for moving vertically within a spring cover of a resin jamb liner;

b. a sash support portion pivotally mounted on said connector portion and shaped to support a sash in a region outside of said spring cover;

c. a neck portion having a narrow width and extending between said sash support portion and a lower region of said connector portion;

d. said connector portion having a friction shoulder wider than said neck portion, spaced above said neck portion, and facing in the direction of said sash support portion;

e. said neck portion forming a pivotal interconnection between said sash support portion and said connector portion so that said sash support portion can pivot in either direction from horizontal; and f. said sash support portion having a friction surface wider than said neck portion, arranged below said friction shoulder, and disposed to face toward said connector portion.

5. The sash platform of claim 4 wherein said neck portion is integral with said connector portion, and said sash support portion connects to and pivots on said neck portion.

6. The sash platform of claim 4 wherein said neck portion is integral with said sash support portion and connects to and pivots on said connector portion.

7. The sash platform of claim 4 wherein said connector portion includes a wedge connector for interlocking with end coils of a spring.

8. A friction system for a sash platform connected to a counterbalance spring system and supporting a sash between a pair of resin jamb liners, said friction system comprising:

a. a connector portion of said sash platform being vertically movable within a spring cover of said jamb liner and connected to said counterbalance spring system arranged within said spring cover;

b. said spring cover being divided by a slit into vertical halves that normally close together and are movable apart from each other;

c. a sash support portion of said sash platform being pivotally connected to said connector portion and having a surface disposed outside of said spring cover for supporting said sash, said sash support portion being tiltable in either direction from horizontal; and d. a narrow width neck extending between said connector portion and said sash support portion, said neck extending through said slit in said spring cover and moving said halves of said spring cover apart in the region of said neck, and said neck affording the pivotal connected between said sash support portion and said connector portion.

9. The friction system of claim 8 including a friction surface of said sash support portion, wider than said neck, engaging an outside surface of said spring cover, and a friction shoulder of said connector portion, wider than said neck, engaging an inside surface of said spring cover above said friction surface.

10. The friction system of claim 8 wherein said neck is integral with and extends from said connector portion.

11. The friction system of claim 8 wherein said neck is integral with and extends from said sash support portion.

12. The friction system of claim 8 wherein said connector portion has a wedge connector for interlocking with end coils of a spring.

13. A method of applying frictional resistance to movement of a sash that is counterbalanced between a pair of resin jamb liners, said method comprising:

a. forming a vertically extending and normally closed slit in a spring cover of said jamb liner and extending a narrow neck region of a sash platform through said slit so that said neck moves vertical halves of said spring cover apart at said slit in the region of said neck to produce a constant friction load resisting vertical movement of said neck in said slit; and b. arranging a friction shoulder on said platform to engage an inside surface of said spring cover and a friction surface on said platform to engage an outside surface of said spring cover below said friction shoulder to deform said spring cover between said friction shoulder and said friction surface as a function of the weight of said sash urging said platform downward and the force of a counterbalance spring system urging said platform upward to produce load-responsive friction, combined with said constant friction load, in resisting vertical movement of said platform.

14. The method of claim 13 including forming said sash platform in two parts that are pivotally connected so that a sash support surface of said platform can tilt in either direction from horizontal.

15. The method of claim 13 including dimensioning said neck and the distance between said friction shoulder and said friction surface so that said constant friction load is about one-half of said load-responsive friction.

16. The method of claim 13 including arranging said neck so that the lightest counterbalance spring system to be used with said platform can raise said platform when the weight of said sash is removed from said platform.

17. The method of claim 13 including arranging said load-responsive friction so that with the heaviest sash and counterbalance system to be used with said platform, said friction shoulder and said friction surface do not jam on said spring cover.

* * * * *